US005665013A

United States Patent [19]

Kobayashi

[11] Patent Number: 5,665,013

[45] Date of Patent: Sep. 9, 1997

[54] IRON-TYPE GOLF CLUB HEAD

[75] Inventor: Kenji Kobayashi, Tsubame, Japan

[73] Assignee: Kabushiki Kaisha Endo Seisakusho, Niigata-ken, Japan

[21] Appl. No.: 665,662

[22] Filed: Jun. 20, 1996

Related U.S. Application Data

[62] Division of Ser. No. 538,296, Oct. 2, 1995.

[30] Foreign Application Priority Data

Aug. 1, 1995 [JP] Japan ..... 7-196725

[51] Int. Cl.[6] ..... A63B 53/04

[52] U.S. Cl. ..... 473/331; 473/349; 473/350

[58] Field of Search ..... 473/324, 325, 473/329, 330, 331, 342, 345, 346, 350, 349

[56] References Cited

U.S. PATENT DOCUMENTS 5,090,702 2/1992 Viste ..... 473/331
5,184,823 2/1993 Desbiolles ..... 473/345

FOREIGN PATENT DOCUMENTS 60-177867 11/1985 Japan .
2-241469 9/1990 Japan .

*Primary Examiner*—Sebastiano Passaniti
*Attorney, Agent, or Firm*—Quarles & Brady

[57] ABSTRACT

An iron-type golf club head having a larger sweet area while insuring a strength of a head. A back surface 1A of a metallic head body 1 is formed with plural rectangular cavities 5, 5A of different dimensions, opposite to the face 4 of the head body 1. The cavities 5, 5A are formed by forging, thus forming even and fine tissues and grain flow. Accordingly, the toughness and durability of material can be enhanced, so that the face 4 can be made thinner to a 1.0 to 3.5 mm thickness for an optimal weight distribution. As a result, a larger sweet area can be realized without damaging a strength of head.

10 Claims, 2 Drawing Sheets

FIG. 1
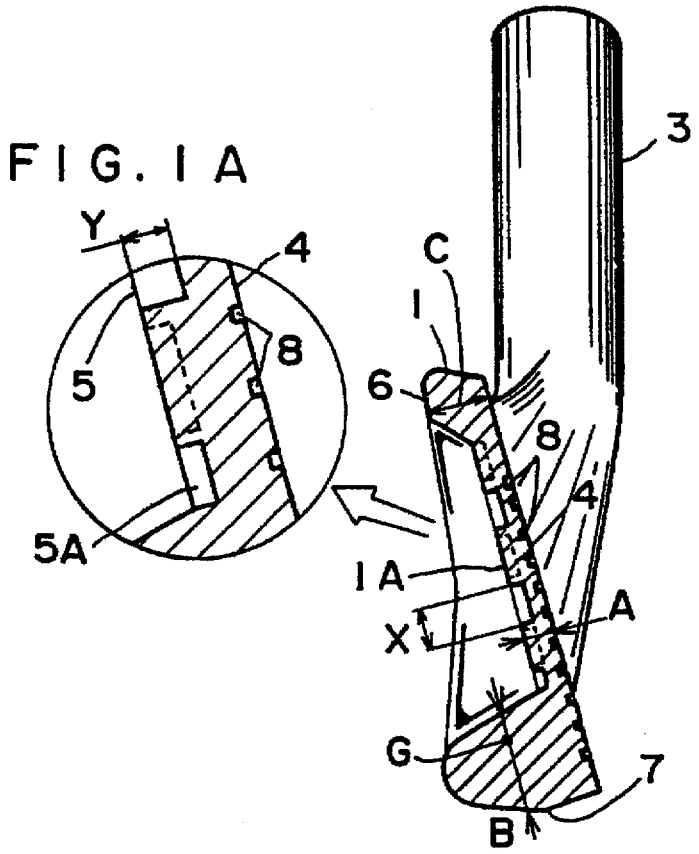
FIG. 1A
FIG. 2
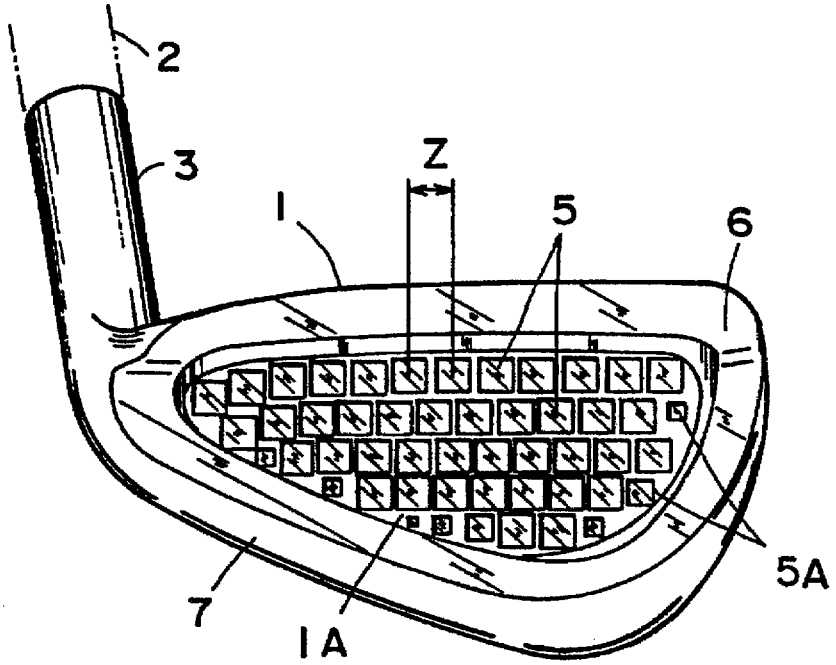

IRON-TYPE GOLF CLUB HEAD

CROSS REFERENCE TO RELATED APPLICATIONS

This application is a divisional application of U.S. Ser. No. 08/538,296, now pending.

BACKGROUND OF THE INVENTION (a) Field of the Invention

The present invention relates to an iron-type golf club head such as an iron, sand wedge or pitching golf club head.

(b) Description of Prior Art

For this kind of golf club head, there is proposed a golf club head disclosed in Japanese U.M.Appln Laid-Open No.60-177867, which discloses in FIG. 2, a golf club head having multiple cavities at its back. The prior golf club head aimed at decreasing air resistance when swinging the same by forming multiple cavities at the back of the head body which had been conventionally formed smooth. Further, there is also proposed another golf club head disclosed in Japanese Patent Appln Laid-Open No.2-241469, which discloses in FIG. 1, a wood-type golf club head having small cavities formed along a peripheral portion of the head body by cutting process. According to the latter prior golf club head, the said small cavities could enchance a sense of beauty.

Whereas, it is widely recognized that for enlargement of so-called sweet area, iron-type golf club head (hereinafter called head) should have an elongated distance between the CG of the head body and the face, or otherwise, should have the weight distribution dispersed toward the periphery thereof by thickening an edge of the face. However, according to the prior golf club heads, the face must be formed to a preset thickness because of requirement for the strength at the time of striking balls, therefore, a predetermined weight would be inevitably required for the ensuring of the thickness of the face. As a result, there has been a problem such that a golf club head can not be formed as you like.

SUMMARY OF THE INVENTION

To eliminate the above-mentioned problems, it is, therefore, an object of the present invention to provide a iron-type golf club head of which the face can be optimally formed when the face is formed thinner.

According to a major feature of the present invention, there is provided an iron-type golf club head comprising: a metallic head body having a shaft attaching portion at one side and a face at its front side; a plurality of cavities formed in a back surface of said head body, corresponding to the face thereof, said cavities being square or rectangular-shaped, formed by forging.

BRIEF DESCRIPTION OF THE DRAWINGS

Other objects, features and advantages of the invention will be apparent to those skilled in the art from the following description of the preferred embodiments of the invention, wherein reference is made to the accompanying drawings, of which: FIG. 1 is a section showing an embodiment of the invention. FIG. 2 is a rear perspective view showing an embodiment of the invention.

DETAILED DESCRIPTION OF THE PREFERRED EMBODIMENTS

Figure 3:
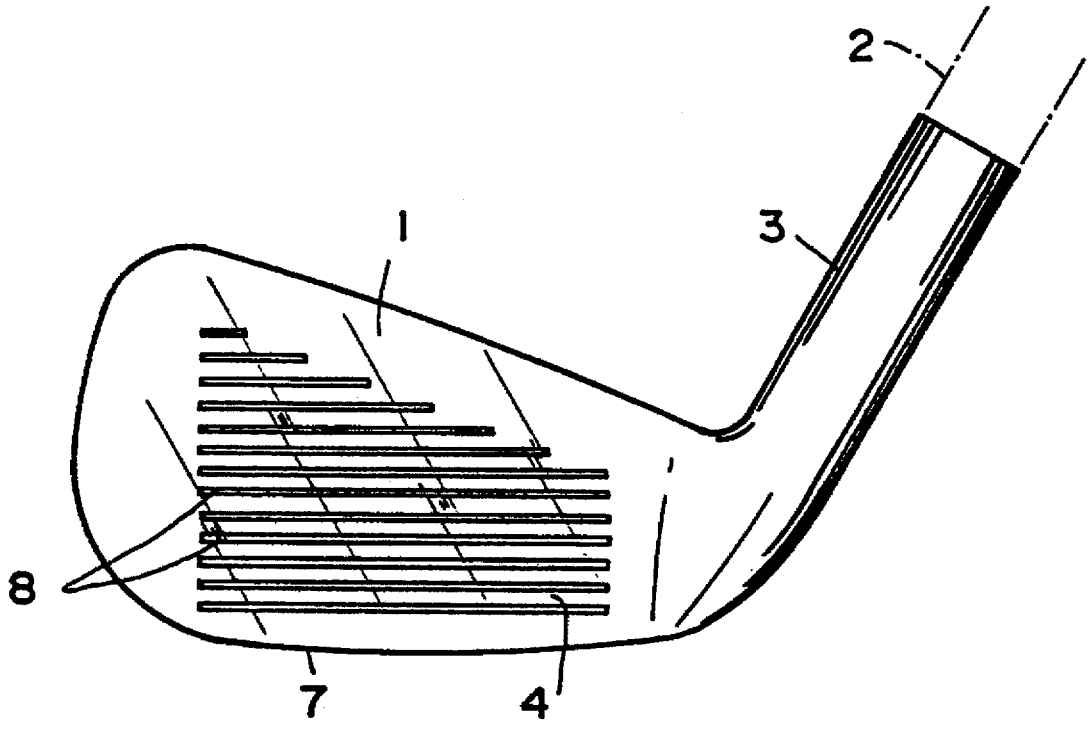
FIG. 3 is a front view showing an embodiment of the invention.

Hereinafter is described an embodiment of a golf club head of the invention with reference to FIGS. 1 to 3, in which reference numeral 1 designates a metallic head body. The head body 1 has a hosel 3 for mounting a shaft 2 thereto, and a face 4 for striking balls at its front. A back surface 1A of the head body 1 is formed with staggered arrangement of plural larger cavities 5 and smaller cavities 5A, which are square or rectangular-shaped both in profile and in plan view, formed rather dense, opposite to the face 4, while a peripheral edge of the back surface 1A is formed with annular projection 6, of which the lower part constructs a sole 7.

Each of the cavities 5 and 5A is disposed in a staggering manner in an area surrounded by the annular projection 6, each having a width X ranging from 3 to 8 mm, preferably 5 to 6 mm for large cavities 5, a depth Y of 0.2 to 1.7 mm, preferably 0.7 to 1.2 mm for large cavities 5, a center to center distance Z between the adjacent cavities 5, 5A ranging from 3 to 10 mm, preferably 5 to 7 mm for large cavities 5. In addition a percentage area of all the cavities 5, 5A to a flat portion 9 hereinbelow described is preferably 70% or above. Incidentally, reference numeral 8 designates grooves called score lines formed on the face 4.

Hereinafter is described a manufacturing method of a golf club head of the invention.

For example, the face 4, the annular projection 6 of the back surface 1A and the flat portion 9 in the center thereof are each formed beforehand by means of hot or cold forging of carbon steels for machine structural use such as JIS standard S20C or S25C, suitable metal such as titanium, titanium alloy or beryllium copper alloy. Specifically, the above steel products should undergo annealing process after the hot forging. Next, the head body 1 is placed on a lower die (not shown) of the forging device, while a lower surface of an upper die (not shown) thereof is formed with convex protrusions (not shown) to form the plural cavities 5, 5A. Then, the upper die is pressed to the flat portion 9 to simultaneously form plural cavities 5, 5A by cold forging. For the steel products, such cavities 5, 5A may be formed by hot forging. After forming the cavities 5, 5A, the grooves 8 are formed, and then, the surface is polished to a final product.

According to a first embodiment of the invention, the back surface 1A of the head body 1 is formed with plural cavities 5, 5A by forging, whereby the face is strengthened in the neighborhood of the center thereof, thus making the thickness A of the face 4 thinner to an about 1.0 to 3.5 mm thickness. As a result, you can distribute a surplus weight thus obtained, for example, to the sole 7 in order to enlarge the thickness B thereof, thereby elongating the distance between the CG of the head body 1 and the face 4 to enlarge a sweet area, or you can also enlarge a sweet area by distributing the surplus weight to the annular projection 6 to make the thickness C greater.

Table 1 shown below indicates the contrast between the results of the tensile tests wherein the plates formed with the equivalents to the cavities 5, 5A (sample Nos.3 and 4) were compared to the plates without the same (sample Nos.1 and 2). Further, the Table 1 also shows the contrast between the results of the bending tests wherein the plate formed with the equivalents to the cavities 5, 5A (sample No.2) was compared to the plate without the same (sample No.1).

TABLE 1

Tensile Test

| No. | sample No. | material | test piece: dimension mm | test piece: cross-sectional area $mm^2$ | test piece: original gauge length mm | tensile: load N | tensile: tensile strength $N/mm^2$ | yield: load N | yield: yield point $N/mm^2$ | yield: yield elongation % | reduction of area % |
|---|---|---|---|---|---|---|---|---|---|---|---|
| 1 | 1 | S20C | 5.8 × 24.5 | 142.1 | 49.9 | 75096 | 528.5 | 52920 | 372.4 | 34.1 | — |
| 2 | 2 | " | 6.0 × 24.3 | 145.8 | 49.6 | 73619 | 504.9 | 54517 | 374.0 | 35.5 | — |
| 3 | 3 | " | 5.8 × 24.5 | 142.1 | 50.1 | 90866 | 639.5 | 63337 | 445.7 | 2.0 | — |
| 4 | 4 | " | 5.8 × 24.4 | 141.5 | 50.0 | 91457 | 646.3 | 62475 | 441.5 | 2.6 | — |

Bending Test

| No. | sample No. | material | test piece: cross-sectional dimension mm | test piece: length mm | angle of bend (deg.) | inside radius mm | bearing distance mm | result crack: on the outer periphery of the bent piece | remark |
|---|---|---|---|---|---|---|---|---|---|
| 1 | 1 | S20C | 5.9 × 20.0 | 149.8 | 180 | 12 | 36 | none | deformation - starting load, note 1): 4288N |
| 2 | 2 | " | 5.9 × 19.6 | 151.0 | 180 | " | " | fractured | deformation - starting load, note 1): 6370N |

notes.
note 1) deformation - starting load was assumed to be a proportional limit in a load-elongation diagram.

According to the result of the tensile test in Table 1, the average tensile strength of the plates with the cavities 5,5A (sample Nos.3 and 4) was 642.9 N/mm, while that of the plates without the cavities 5,5A (sample Nos.1 and 2) 516.7 N/mm, which indicated that the forming of the cavities could increase the tensile strength by 24.4%. Whilst, according to the result of the bending test in Table 1, the deformation-starting load of the plate with the cavities 5,5A (sample No.2) was 6,370 N, while that of the plate without the cavities 5,5A (sample No.1) 4,288 N, which indicated that the forming of the cavities could increase the bending strength by 48.5%. Such improvement of the strength presumably results from the enhanced toughness and durability of the material associated with the formation of even and fine tissues and grain flows by forming cavities 5,5A by means of forging. Further, the above-mentioned grain flows are hard to disconnect, thereby further improving the strength. In addition, as the cavities 5 are formed relatively larger than the cavities 5A, both being square or rectangular-shaped, they can be formed dense.

Incidentally, the present invention should not be limited to the foregoing embodiment, but may be modified within a technical scope of the invention.

What is claimed is:

1. An iron-type golf club head comprising:

an iron-type metallic head body having a shaft attaching portion at one side and a face at its front side;

a plurality of cavities formed in a back surface of distinct said iron-type head body, each being rectangular shaped both in profile and plan view opposite to the face thereof, said cavities being formed by forging, whereby forging of said cavities increases the grain flow of the metallic head body within said cavities.

2. An iron-type golf club head according to claim 1, wherein said back surface is a back surface of said face.

3. An iron-type golf club head according to claim 2, wherein a thickness of said face is within a range from 1.0 to 3.5 mm.

4. An iron type golf club head according to claim 2, wherein said cavities are of different dimensions.

5. An iron-type golf club head according to claim 2, wherein each width of said cavities is within a range from 3.0 to 8.0 mm, while each depth thereof is 0.2 to 1.7 mm.

6. An iron-type golf club head according to claim 2, wherein a center to center distance between the adjacent cavities is within a range from 3 to 10 mm.

7. An iron-type golf club head according to claim 2, wherein a percentage area of said cavities to a flat portion of the back surface of said face is 70% or above.

8. An iron-type golf club head according to claim 2, wherein said head body is formed of carbon steels for machine structural use or metal comprising titanium, titanium alloy, or beryllium copper alloy by forging.

9. An iron-type golf club head according to claim 2, wherein said rectangular-shaped cavities have a variety of configurations.

10. An iron-type golf club head according to claim 2, wherein said rectangular shaped cavities are square shaped.

* * * * *